US006591768B2

(12) United States Patent
Kessler et al.

(10) Patent No.: US 6,591,768 B2
(45) Date of Patent: Jul. 15, 2003

(54) BUTTON SEWING DEVICE

(75) Inventors: Rolf Kessler, Karlsruhe (DE); Peter Schutt, Karlsbad (DE)

(73) Assignee: VSM Group AB, Huskvarna (SE)

( * ) Notice: Subject to any disclaimer, the term of this patent is extended or adjusted under 35 U.S.C. 154(b) by 0 days.

(21) Appl. No.: 10/163,576

(22) Filed: Jun. 6, 2002

(65) Prior Publication Data

US 2002/0185044 A1 Dec. 12, 2002

(30) Foreign Application Priority Data

Jun. 8, 1922 (DE) ..... 10128035

(51) Int. Cl.[7] ..... D05B 03/14; D05B 29/12
(52) U.S. Cl. ..... 112/110; 112/235
(58) Field of Search ..... 112/2, 110, 113, 112/115, 235, 65, 70, 76

(56) References Cited

U.S. PATENT DOCUMENTS 1,359,858 A * 11/1920 Barron
2,331,170 A * 10/1943 Brussell
2,942,565 A * 6/1960 Johnson
4,216,732 A * 8/1980 Marsh et al.

FOREIGN PATENT DOCUMENTS

DE 1 037 824 2/1959
DE 28 30 903 1/1979

* cited by examiner

*Primary Examiner*—Ismael Izaguirre
(74) *Attorney, Agent, or Firm*—Pearne & Gordon LLP

(57) ABSTRACT

The device is designed for sewing buttons (28) using common household sewing machines. To simplify button sewing with household sewing machines, the invention proposes a button-sewing foot (10) which can be snapped into the pressure-foot holder (14) of the sewing machine. By means of retaining elements (26, 30) the button (28) can be pressed against the button-sewing foot (10) in such fashion that, independent of the position of the latter, the needle of the sewing machine can be aligned with a given button perforation (32).

9 Claims, 3 Drawing Sheets

BUTTON SEWING DEVICE

This invention relates to a device for sewing on buttons, incorporating in particular a button-sewing foot which features retaining elements that serve to hold the button against the button-sewing foot in such fashion that, independent of the position of the latter, the needle of the sewing machine can be aligned with a specific button perforation.

Various devices designed for automatic button sewing have already been introduced in the industrial sector. For example, DE 1 037 824 B describes a sewing machine equipped with a special, fixed button-sewing foot. For general-purpose household sewing machines, however, makeshift solutions have had to be employed for attaching buttons to the fabric. In one such known approach the button is placed under a suitable pressure foot and sewed on in zigzag fashion; the drawback here is the partial concealment of the button during the sewing process which can easily lead to a damaged button or needle or a shifting of the button as it is sewed on. Another known practice when sewing on buttons with a stem has been to place a match stick between the pressure foot and the button and to withdraw the match stick after the button is on. The drawback is again the partial concealment of the button and the need to improvise by using a makeshift device such as a match stick.

As a matter of expediency, a button to be attached can be clamped down by lowering the pressure foot. However, while this permits a clear view of the button, the latter is clamped down off center which becomes a problem especially in the case of thick fabrics. Besides, this does not allow for buttons to be sewed on with a stem.

It is the objective of this invention to introduce a device which, by simple manipulation, facilitates the sewing of buttons even on common household sewing machines.

According to the invention, this objective is achieved by means of a button-sewing foot which can be snapped into the pressure-foot holder of the sewing machine and whose retaining elements are essentially in the form of spring clips the two legs of which push from underneath against the perimeter of the button outside the button perforations, clamping the button against the bottom of the button-sewing foot.

The advantage of the button-sewing foot according to this invention which, replacing the regular pressure foot, is snapped into the pressure-foot holder of the sewing machine, is that with the aid of the retaining elements it locks the button immovably in the desired position, thus permitting particularly simple and well-controlled manipulation as the button is sewed on. The retaining elements themselves can help to properly align the button perforations in that, preferably, the operator can see these perforations of the clamped button from the top so as to better control the sewing process and to be able to stop it once enough needle loops have been made. Lifting or lowering the button-sewing foot does not affect proper alignment.

Since the retaining elements clamp the button against the bottom of the button-sewing foot, it is possible by lowering the button-sewing foot to firmly press the button against the fabric without requiring any particularly rigid or sturdy retaining elements.

Using retaining elements in the form of spring clips, whose two legs push from underneath against the perimeter of the button away from the button perforations, allows for particularly simple and cost-effective fabrication, while suitably angled spring-clip legs permit easy insertion of the button between a given surface of the button-sewing foot and said legs. Appropriate stops on the button-sewing foot or a special profile of the spring-clip legs may serve to properly align the button in the desired stitching position. Normally, however, the button is simply slipped in and aligned as required based on the position of the button perforations.

To permit buttons to be attached to the fabric with either a stem or flush without a stem, a particularly preferred embodiment of this invention provides for the device to incorporate a two-position selector slide by means of which it is possible to switch from a first setting for sewing on buttons flush to a second setting which increases the length of the thread as it is looped through the button perforations.

The advantage of this concept of selectable settings lies in the universal suitability of the button-sewing foot, requiring no additional auxiliary elements.

In a first design version the selector slide may be tongue-shaped, permitting its repositioning in a second location above or below the button between the button perforations. When employing this design variation, the added length of the needle loop needed to form the stem is obtained by first sewing over the tongue-shaped selector slide. On completion of the sewing process the selector slide is pushed back into its home position, the fabric and the button are spread apart and the resulting stem is wrapped and tied with thread.

In preferred design enhancements of the adjustable selector slide, the slide is held in place in a guide on the button-sewing foot and can be click-stopped in either position for instance in that the bottom end of a sewing-foot pin is snapped into the pressure-foot holder of the sewing machine while said pin can engage in either one of two mutually distant detents on the upper surface of the tongue-shaped selector slide.

As an alternative to the tongue-shaped selector slide that is adjustable relative to the button perforations, a selector slide may be provided which in its second position constitutes a spacer between the button and the fabric to which the button is to be fastened.

Another possibility is a button-sewing foot which allows for the fastening of a button with a stem not by means of a movable adjustment but instead with the aid of detachable retaining elements, in which case a first set of retaining elements for the flush fastening of a button is interchangeable with a second set of retaining elements for sewing on a button with a stem.

In this design version of the button-sewing foot, the insertion of the second set of retaining elements that serves for sewing on a button with a stem, forces a certain distance from the fabric even with the sewing foot lowered, thus providing that extra length of the needle loop required for forming the stem in the sewing process. The retaining elements may again be in the form of spring clips, in which case the legs of the second set of retaining elements define a specific spacing between the fabric and the button.

The following will explain this invention in more detail with the aid of design examples and with reference to the attached drawings in which.

Figure 1:
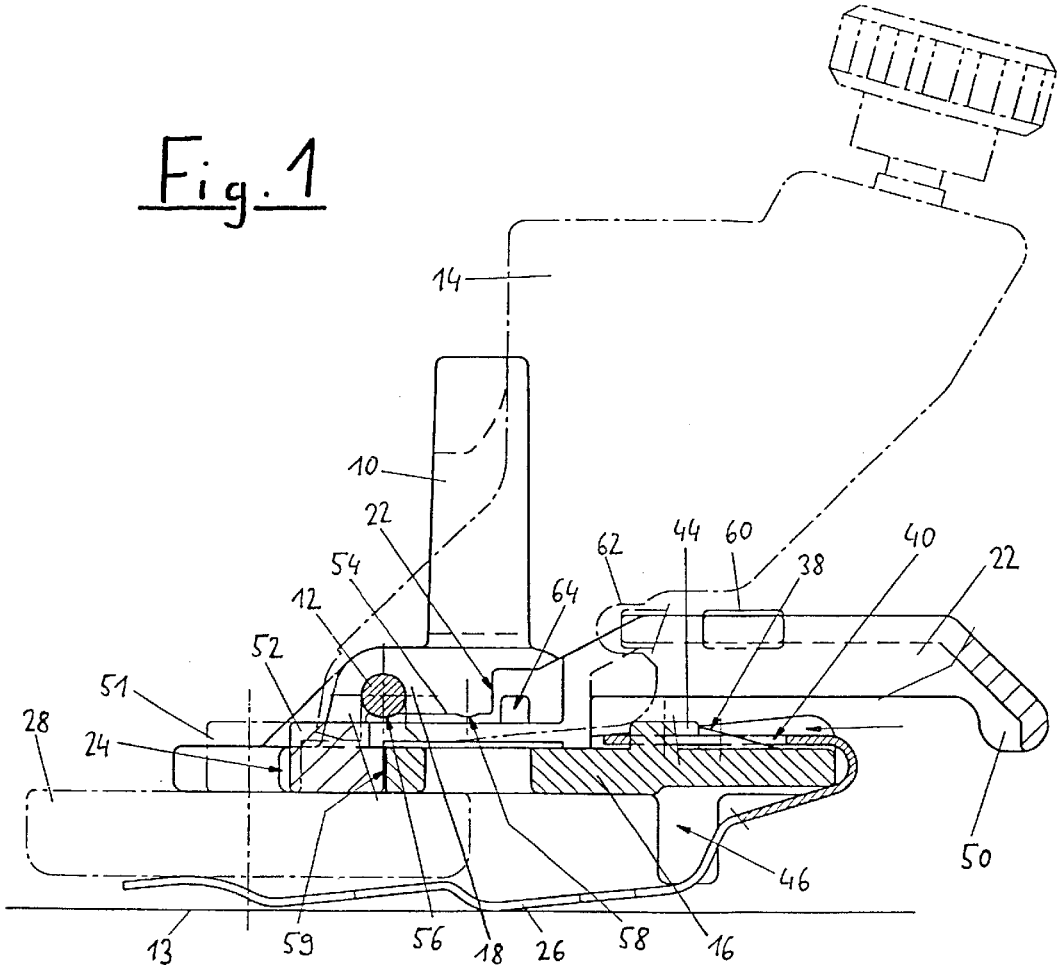
FIG. 1 is a side view of a button-sewing foot.
Figure 2:
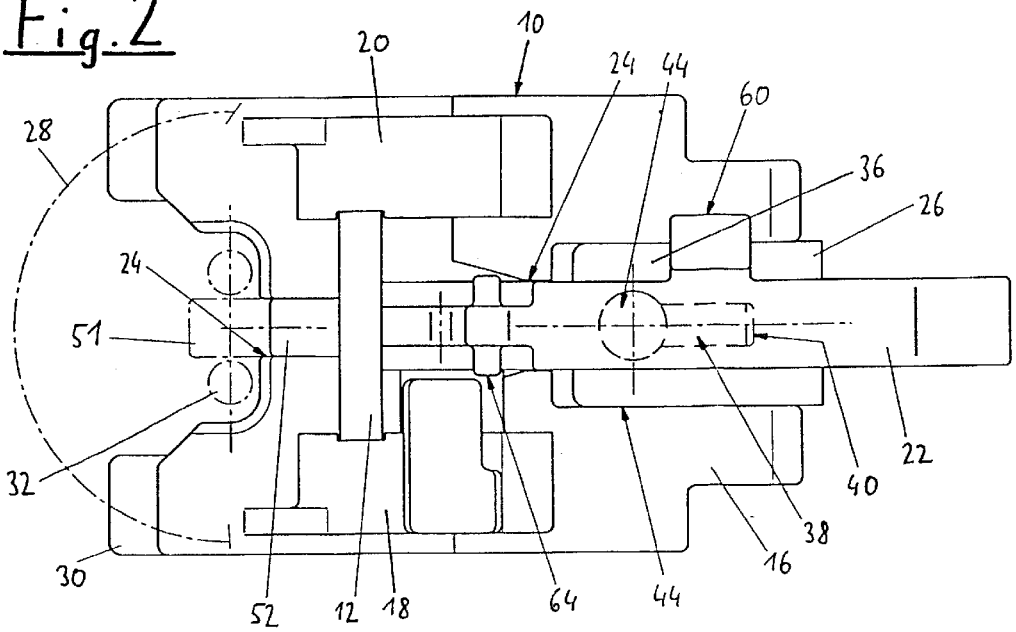
FIG. 2 is a top view of the button-sewing foot per FIG. 1.
Figure 3:
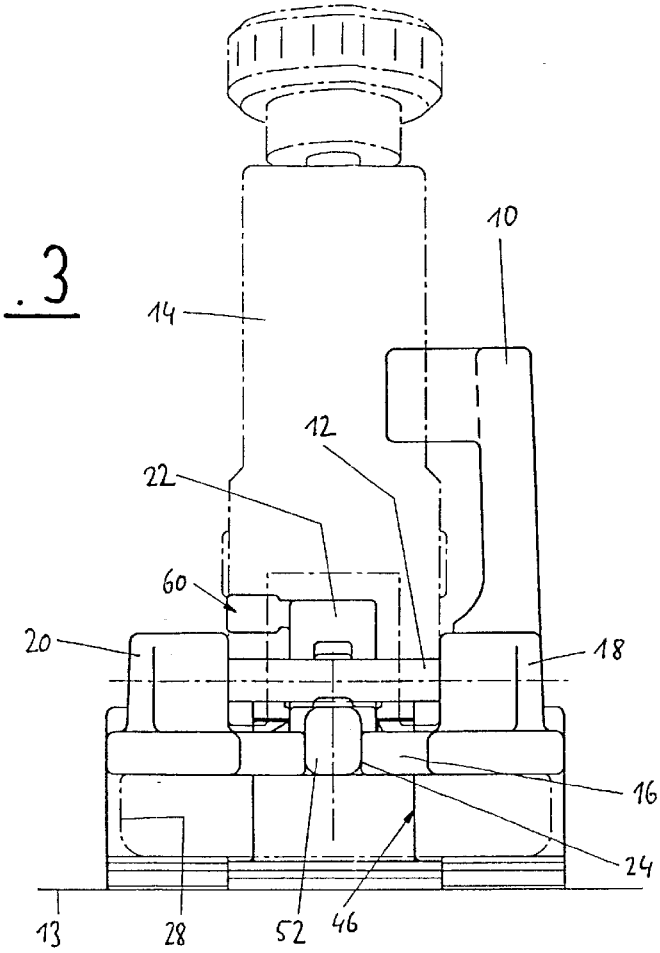
FIG. 3 is a front view of the button-sewing foot per FIG. 1.

FIG. 1 illustrates a button-sewing foot 10 which by way of a sewing-foot pin 12 is snapped into a pressure-foot holder 14 (represented by the dotted line) and which can be lowered onto a fabric 13.

The button-sewing foot 10 essentially consists of a plate-shaped base unit 16 with two locators 18, 20 between which the sewing-foot pin 12 is positioned, a selector slide 22 with a tongue-shaped forward end which slide can be moved in a guide 24 provided in the base unit 16, and a retaining element in the form of a captive spring clip 26 which serves to clamp a button 28 against the bottom surface of the base unit 16, thus holding it in place on the button-sewing foot 10 with adequate firmness. The spring clip 26 has two spring legs 30 which push against the button in an area away from the button perforations 32, thus keeping the needle path clear. An opening 34 in the base unit 16 of the button-sewing foot 10 allows for an unobstructed view of the needle path and thus for proper alignment of the button perforations 32 when the button is inserted between the spring legs and the base unit.

The spring clip 26 whose spring legs 30 extend across the entire bottom surface of the base unit 16 features a looped-back, closed end section 36 which is tensioned around the rear end of the base unit 16. The end section 36 is provided with a perforation 40 which, sliding up a ramp 38 over a protrusion 42 in the base unit 16, is snapped in place in captive fashion. For lateral support of the spring clip 26 the end section 36 of the spring clip 26 is positioned in a groove 44 on the top surface of the base unit 16 while an additional support element 46 is provided between the spring legs 30 on the bottom surface of the base unit.

The movable selector slide 22, provided with an integral handle 50, can be shifted between a retracted position and a forward position (next to 51) in which a rectangular tongue 52 projects between the button perforations 32 of the clamped button 28. In this latter position a button can be sewed on with a stem since in its forward position the tongue 52 causes the button to be sewed on with a correspondingly longer needle loop; after the fabric with the sewed-on button is removed, the button can be pulled up and the thread can be wrapped and tied to form a stem between the fabric and the button. The two positions of the selector slide are defined by a noticeable click, in that, on the top surface of a raised area 54 behind the tongue of the selector slide 22, a horizontal forward groove 56 and a horizontal rearward groove 58 are provided which accept the bottom end of the sewing-foot pin 7 with a noticeable click. In the retracted position of the selector slide 22 in which buttons are sewed on flush i.e. without a stem and which is defined by a stop 59, the sewing-foot pin 12 is engaged in the forward groove 56, while in the forward position of the tongue 52 the bottom end of the sewing-foot pin 12 engages in the rearward groove 58. When the selector slide 22 clicks into the rearward groove 58, it is additionally supported by a lug 60 which reaches into an opening 62 of the pressure-foot holder 14. In this position, another support element 64 of the selector slide 22 provides additional support by reaching into another opening, not shown, in the pressure-foot holder 14.

As mentioned above, the button may be aligned visually based on the button perforations visible through the opening 34 in the base unit 16, in which case positive positioning is ensured regardless of the size of the button. The clamping pressure of the spring legs 30 is sufficiently strong to prevent a shifting of the button 28 for instance when the button-sewing foot 10 is lowered onto the fabric 13. It would be possible to provide stops serving to define the position of the button, but these should ideally be adjustable to accommodate and align buttons of different sizes.

Figure 4:
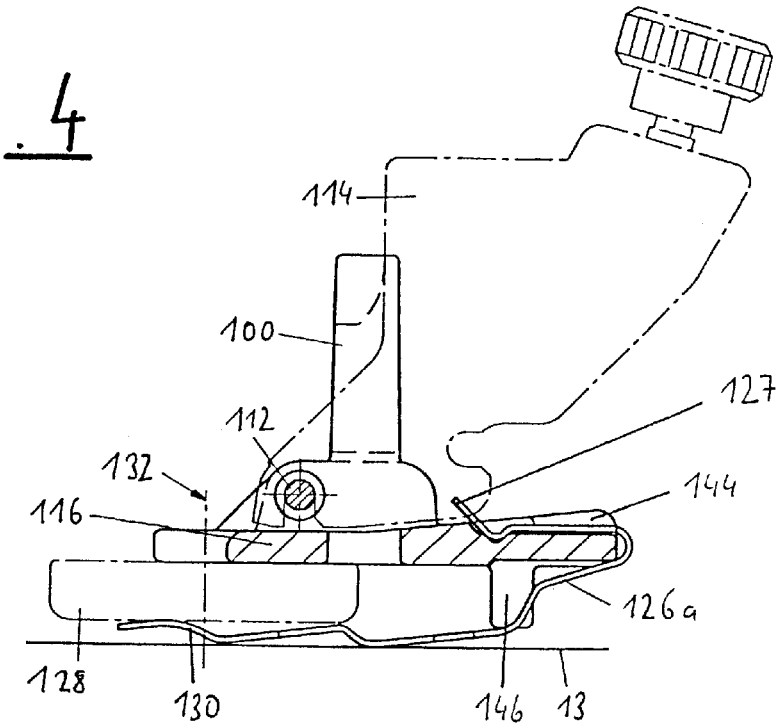
FIG. 4 is a side view of another button-sewing foot.
Figure 5:
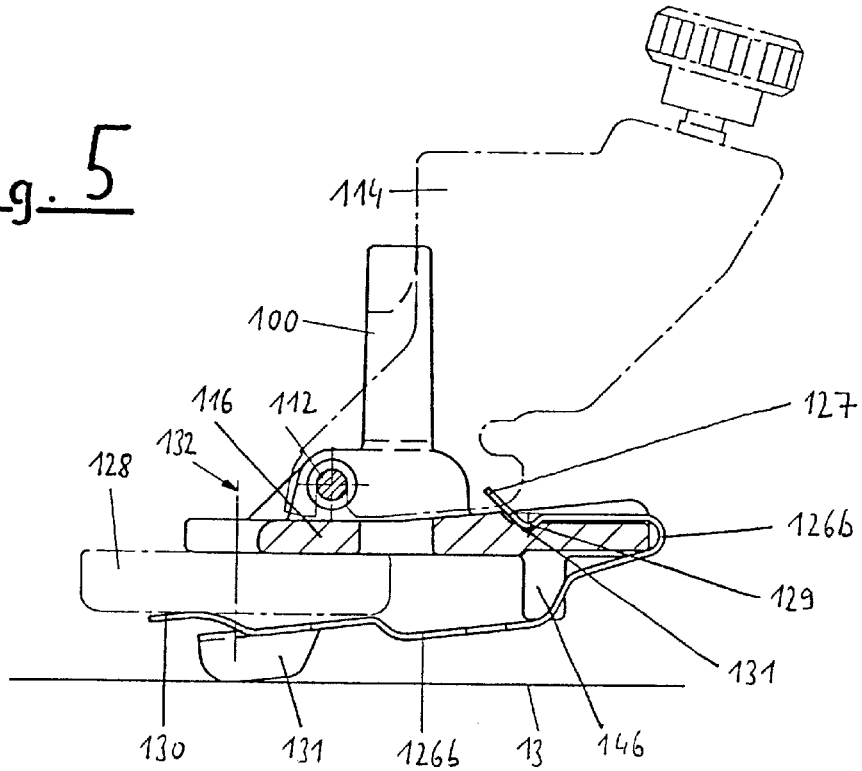
FIG. 5 is a side view of the button-sewing foot per FIG. 4, with the button-retaining elements interchanged.

As an alternative to a selector slide for sewing on buttons both with and without a stem, the design version of a button-sewing foot 100 as depicted in FIGS. 4 and 5 is equipped with an interchangeable spring clip 126*a*. The button-sewing foot 100 again encompasses a plate-shaped base unit 116 with brackets 118 for accepting a sewing-foot pin 112 by means of which the button-sewing foot 100 can be snapped into a pressure-foot holder 114. Omitting the selector slide makes for a substantially simplified configuration of the base unit 116 which only has to include catch provisions for the spring clip 126*a*. A groove 144 and a support element 146 again ensure lateral support for the spring clip 126*a* and its spring legs 130. The design variant shown in FIG. 4, equipped with the spring clip 126*a*, is suitable for fastening buttons without a stem, whereas FIG. 5 illustrates the button-sewing foot 100 with a spring clip 126*a* next to whose legs 130 a spacer 131 is provided which enlarges the distance between the fabric 113 and the bottom surface of the button. This again increases the length of the thread or needle loop when the button 128 is sewed on. Wrapping and tying the thread creates the stem between the button and the fabric. For interchanging the spring clips 126*a* and 126*b*, the button is removed, the spring clip 127 is lifted which disengages a click-stop latch 129 from a groove 131 in the base unit 116, allowing the spring clip 126*a* or 126*b*, as the case may be, to be pulled out toward the rear and replaced by the respective other spring clip. While this design version involves a slightly greater manipulating effort, its advantage lies in its particularly simple mechanical configuration.

What is claimed:

1. Button-sewing foot for sewing on buttons (28; 128), provided with retaining elements (26; 30; 126*a*, 126*b*; 130) by means of which the button (28; 128) can be clamped against the button-sewing foot (10; 100), independent of the position of the latter, in such fashion that the needle of the sewing machine is aligned with a given button perforation (32), characterized in that the button-sewing foot can be snapped into the detent of the pressure-foot holder (14; 114) of common household sewing machines and that the said retaining elements are essentially in the form of spring clips (26; 126*a*, 126*b*) whose two legs (30; 130) press against the bottom surface of the button (28; 128) away from the button perforations (32), thus clamping the button (28; 128) from underneath against the button-sewing foot (10, 16; 100, 116).

2. Button-sewing foot as in claim 1, characterized in that a selector slide (22) can be moved from a first position in which a button can be sewed on flush without a stem, into a second position for increasing the thread length of the needle loop through the button perforations (32).

3. Button-sewing foot as in claim 2, characterized in that the selector slide (22) is at least in part tongue-shaped (52) and can be moved into the second position between the button perforations (32) either above or below the button (28).

4. Button-sewing foot as in claim 3, characterized in that the tongue-shaped selector slide (22, 52) is supported in a guide (24) on the button-sewing foot (10) and can be engaged in click-stop fashion in the detent of either position.

5. Button-sewing foot as in claim 4, characterized in that the click-stop effect is obtained by the latching interaction between the bottom end of a sewing-foot pin (12) which can be caused to engage in the pressure-foot holder (14) of the sewing machine, and either one of two grooves (56, 58) provided at a distance from each other on the top surface (54) of the selector slide (22).

6. Button-sewing foot as in claim 2, characterized in that, in its second position, the selector slide constitutes a spacer between the button and the fabric to which it is to be fastened.

7. Button-sewing foot as in claim 1, characterized in that the retaining elements are detachable and that a first retaining-element assembly (126*a*) which serves for the flush fastening of a button without a stem is interchangeable with a second retaining-element assembly (126*b*) for sewing on a button with a stem.

8. Button-sewing foot as in claim 7, characterized in that the first and second retaining elements are in the form of spring clips (126*a*, 126*b*) and that the legs (130) of the second spring clip (126*b*) define a specific distance between the fabric and the button.

9. Button-sewing foot as in one of the preceding claims, characterized in that it permits the button perforations (32) of a button (28) clamped in place to be seen from the top.

* * * * *

UNITED STATES PATENT AND TRADEMARK OFFICE

CERTIFICATE OF CORRECTION

PATENT NO. : 6,591,768 B1
DATED : July 15, 2003
INVENTOR(S) : Kessler et al.

It is certified that error appears in the above-identified patent and that said Letters Patent is hereby corrected as shown below:

Title page,
Item [30], Foreign Application Priority Data, please delete "Jun. 8, 1922" and insert -- Jun. 8, 2001 --.

Signed and Sealed this

Twenty-eighth Day of October, 2003

JAMES E. ROGAN
*Director of the United States Patent and Trademark Office*